US010492257B2

(12) United States Patent
Seki

(10) Patent No.: US 10,492,257 B2
(45) **Date of Patent: *Nov. 26, 2019**

(54) LIGHTING DEVICE AND LIGHTING FIXTURE

(71) Applicant: Panasonic Intellectual Property Management Co., Ltd., Osaka (JP)

(72) Inventor: Keisuke Seki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,446

(22) Filed: May 16, 2017

(65) Prior Publication Data

US 2017/0339760 A1 Nov. 23, 2017

(30) Foreign Application Priority Data

May 20, 2016 (JP) ..... 2016-101956
May 20, 2016 (JP) ..... 2016-101968

(51) Int. Cl.
*H05B 33/08* (2006.01)

(52) U.S. Cl.
CPC ..... *H05B 33/0827* (2013.01); *H05B 33/083* (2013.01); *H05B 33/0866* (2013.01)

(58) Field of Classification Search
CPC ..... H05B 33/0827; H05B 33/083; H05B 33/0845; H05B 33/0884; H05B 33/0866;
(Continued)

(56) References Cited

U.S. PATENT DOCUMENTS 9,185,755 B2 * 11/2015 Sutardja ..... H05B 33/0857
2012/0038292 A1 * 2/2012 Kuo ..... H05B 33/0818 315/297

(Continued)

FOREIGN PATENT DOCUMENTS

JP 3-74021 U 7/1991
JP 04-296489 A 10/1992

(Continued)

*Primary Examiner* — Wei (Victor) Y Chan
*Assistant Examiner* — Henry Luong
(74) *Attorney, Agent, or Firm* — Renner, Otto, Boisselle & Sklar, LLP

(57) ABSTRACT

A lighting device is configured to be connected to a power switch and supply a plurality of light-emitting elements with current and includes: a DC-power supply circuit configured to supply the plurality of light-emitting elements with the current when the power switch is turned on; a switching circuit for switching which light-emitting element or light-emitting elements among the plurality of light-emitting elements is supplied with the current; a detection circuit which detects current or voltage supplied from the DC-power supply circuit; and a control circuit which controls the switching circuit to switch which of the light-emitting element or light-emitting elements from among the plurality of light-emitting elements is supplied with the current, when the power switch is turned from on to off and back to on within a predefined period and the current or the voltage detected by the detection circuit is less than when the power switch is on.

20 Claims, 19 Drawing Sheets

(58) Field of Classification Search
CPC . H05B 37/02; H05B 37/0209; H05B 37/0281
See application file for complete search history.

(56) References Cited

U.S. PATENT DOCUMENTS

| | | | | |
|---|---|---|---|---|
| 2013/0043801 | A1* | 2/2013 | Kuwu | H05B 33/0818 315/210 |
| 2013/0278145 | A1* | 10/2013 | Lin | H05B 33/0851 315/122 |
| 2014/0015421 | A1* | 1/2014 | Mituyasu | H05B 33/08 315/158 |
| 2014/0091723 | A1* | 4/2014 | Kuo | H05B 33/0818 315/200 R |
| 2014/0210357 | A1* | 7/2014 | Yan | H05B 33/0824 315/186 |
| 2018/0103523 | A1* | 4/2018 | Yan | H05B 33/0824 |

FOREIGN PATENT DOCUMENTS

| | | | |
|---|---|---|---|
| JP | 2008-262891 | A | 10/2008 |
| JP | 2010-183729 | A | 8/2010 |
| JP | 2011-009077 | A | 1/2011 |
| JP | 5420106 | B2 | 11/2013 |
| JP | 2014-007164 | A | 1/2014 |

* cited by examiner

LIGHTING DEVICE AND LIGHTING FIXTURE

CROSS REFERENCE TO RELATED APPLICATION

This application claims the benefit of priority of Japanese Patent Application Number 2016-101956 filed on May 20, 2016 and Japanese Patent Application Number 2016-101968 filed on May 20, 2016, the entire contents of which are hereby incorporated by reference.

1. TECHNICAL FIELD

The present disclosure relates to a lighting device and a lighting fixture, and, in particular, to a lighting device which supplies light-emitting elements with current.

2. DESCRIPTION OF THE RELATED ART

For example, a technology is known which consecutively switches a power switch, such as a wall switch, between on and off to switch a light-emitting element to be caused to emit light (for example, see PTL 1: Japanese Patent No. 5420106).

SUMMARY

According to the technology disclosed in PTL 1, on and off of the power switch is detected by detecting voltage before being input to a DC-power supply circuit. A problem with this case is that the DC-power supply circuit needs to be changed and a general-purpose DC-power supply circuit thus cannot be employed. Specifically, a detection circuit for detecting the voltage mentioned above is additionally required. Moreover, a dedicated IC or microcomputer is required. Since the DC-power supply circuit needs to be changed, the development effort increases as well.

Thus, an object of the present disclosure is to provide a lighting device or a lighting fixture which detects consecutive switching of a power switch, without changing a DC-power supply circuit.

A lighting device according to one aspect of the present disclosure is configured to be connected to a power switch and supply a plurality of light-emitting elements with current, the lighting device including: a DC-power supply circuit configured to supply the plurality of light-emitting elements with the current when the power switch is turned on; a switching circuit for switching which light-emitting element or light-emitting elements from among the plurality of light-emitting elements is supplied with the current; a detection circuit which detects current or voltage supplied from the DC-power supply circuit; and a control circuit which controls the switching circuit to switch which of the light-emitting element or light-emitting elements from among the plurality of light-emitting elements is supplied with the current when the power switch is turned from on to off and back to on within a predefined period and the current or the voltage detected by the detection circuit is less than when the power switch is on.

The present disclosure provides a lighting device or a lighting fixture which detects consecutive switching of a power switch, without changing a DC-power supply circuit.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 15 is a diagram illustrating an operation of a reset circuit according to Embodiment 2 upon power-on;

FIG. 19 is a diagram illustrating an operation of a reset circuit according to Variation 2 of Embodiment 2 upon power-on;

DETAILED DESCRIPTION OF THE EMBODIMENTS

Hereinafter, embodiments according to the present disclosure are described with reference to the accompanying drawings. The embodiments described below are each merely one specific example of the present disclosure. Thus, values, shapes, materials, components, and arrangement and connection between the components shown in the following embodiments are merely by way of illustration and not intended to limit the present disclosure. Therefore, among the components in the embodiments below, components not recited in any one of the independent claims defining the most generic part of the inventive concept of the present disclosure are described as arbitrary components.

The figures are schematic views and do not necessarily illustrate the present disclosure precisely. In the figures, the same reference sign is used to refer to substantially the same configuration, and duplicate description is omitted or simplified.

Embodiment 1

[Configuration of Lighting Fixture]

Figure 1:
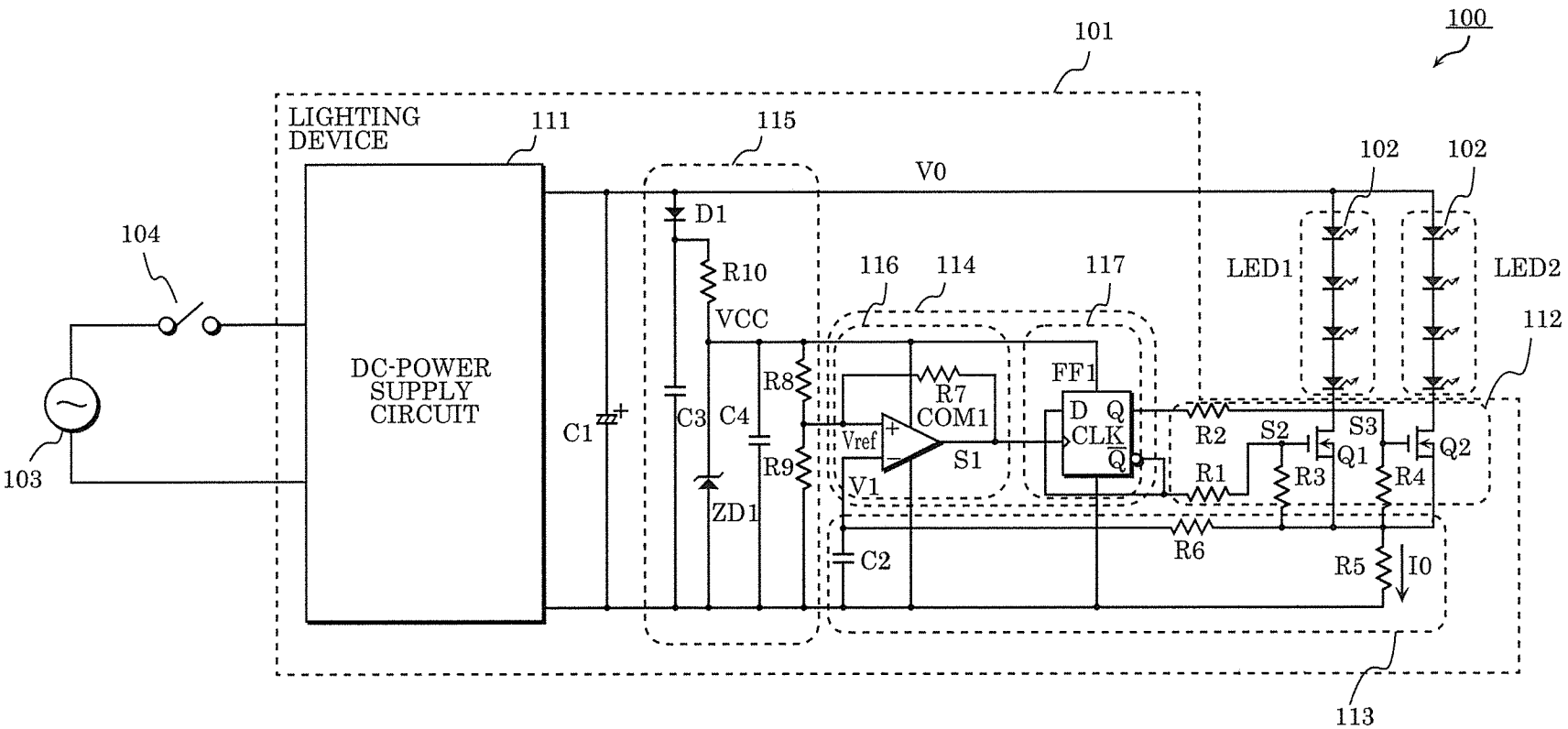
FIG. 1 is a diagram showing a configuration example of a lighting fixture according to Embodiment 1 of the present disclosure.

Initially, a configuration of lighting fixture 100 according to the present embodiment is described. FIG. 1 is a diagram illustrating a configuration of lighting fixture 100 according to the present embodiment. As illustrated in FIG. 1, lighting fixture 100 includes lighting device 101 and light-emitting elements 102.

Lighting device 101 turns on light-emitting elements 102, using power from mains supply 103. Power switch 104, such as a wall switch, is connected between lighting device 101 and mains supply 103. In other words, supply of power from mains supply 103 to lighting device 101 is switched between on and off, based upon on and off of power switch 104, thereby switching the supply of power to light-emitting elements 102 between on and off.

Lighting device 101 includes DC-power supply circuit 111, switching circuit 112, detection circuit 113, control circuit 114, controlled power supply circuit 115, and capacitor C1.

DC-power supply circuit 111 converts AC power supplied from mains supply 103 into DC power and generates constant current using the DC power. DC-power supply circuit 111, for example, includes an AC-to-DC converter and a DC-to-DC converter. The constant current generated by DC-power supply circuit 111 is supplied to light-emitting elements 102.

Capacitor C1 is a capacitor element connected to an output terminal of DC-power supply circuit 111 and used to smooth the constant current generated by DC-power supply circuit 111. While capacitor C1 is provided outside DC-power supply circuit 111 in FIG. 1, it should be noted that capacitor C1 may be included in DC-power supply circuit 111.

Light-emitting elements 102 are solid-state light-emitting elements, for example, light-emitting diodes (LEDs). Light-emitting elements 102 are arranged in light-emitting groups LED1 and LED2. For example, light-emitting element 102 belonging to light-emitting group LED1 and light-emitting element 102 belonging to light-emitting group LED2 emit light having different emission colors (color temperatures). Light-emitting elements 102 for each light-emitting group are connected in series.

Switching circuit 112 switches which light-emitting group from among light-emitting groups LED1 and LED2 is supplied with current. In other words, switching circuit 112 switches light-emitting element(s) 102 which is supplied with current, from among light-emitting elements 102. Switching circuit 112 includes switching elements Q1 and Q2 and resistors R1, R2, R3, and R4.

Switching elements Q1 and Q2 are for switching which light-emitting group LED1 or LED2 is supplied with current. Switching elements Q1 and Q2 are, for example, MOSFETs. Switching element Q1 is connected to light-emitting group LED1 in series. Switching element Q2 is connected to light-emitting group LED2 in series. Note that resistors R1 and R2 are for inhibiting an instant high current, and resistors R3 and R4 are for fixing the gate voltages of switching elements Q1 and Q2 to the GND level, as a countermeasure for stray capacitance.

Detection circuit 113 is for detecting current I0 supplied from DC-power supply circuit 111. Stated differently, detection circuit 113 detects current I0 through light-emitting elements 102. Detection circuit 113 includes resistors R5 and R6 and capacitor C2. Detection circuit 113 converts detection current I0 through resistor R5 into detection voltage V1. Current I0 through resistor R5 corresponds to current through light-emitting elements 102. Note that resistor R6 and capacitor C2 function as a low pass filter and prevent unexpected switching operation caused by an event of an instant power failure or extraneous noise in a short time.

If power switch 104 is temporarily turned off and current I0 detected by detection circuit 113 is less than a value (for example, a predetermined reference value) that is detected when power switch 104 is on, control circuit 114 controls switching circuit 112 to switch which light-emitting element 102 from among light-emitting elements 102 is supplied with current. Specifically, control circuit 114 switches which of the light-emitting element or light-emitting elements from among light-emitting elements 102 is supplied with the current on a group-by-group basis among light-emitting groups LED1 and LED2. The expression "power switch 104 is temporarily turned off," as used herein, refers to a fact that power switch 104 changes from on-state to off-state, and back to on-state within a predefined period. The predefined period is, for example, about 0.1 second to about 3 seconds. Preferably, the predefined period is about 0.1 second to about 2 seconds. More preferably, the predefined period is about 0.1 second to about 1 second. Control circuit 114 includes comparison circuit 116 and sequential circuit 117.

Comparison circuit 116 compares detection voltage V1 with a predetermined reference voltage VRef and outputs comparison result signal S1 indicating a result of the comparison. For example, comparison circuit 116 outputs low signal S1 in normal operation (when detection current I0 is higher than the reference value), and outputs high signal S1 when detection current I0 is lower than the reference value. Comparison circuit 116 includes comparator COM1. Comparator COM1 compares detection voltage V1 with reference voltage VRef and outputs signal S1 indicating a result of the comparison. Note that hysteresis property of comparison circuit 116 is implemented by resistor R7.

Sequential circuit 117 inverts logic values of output signals S2 and S3, based on a change in comparison result signal S1. Sequential circuit 117 includes flip flop FF1. Specifically, sequential circuit 117 inverts logic values of output signals S2 and S3 at a rising edge of comparison result signal S1. Note that output signal S2 is an inverted signal of output signal S3. Output signal S2 is supplied to the gate terminal of switching element Q1. Output signal S3 is supplied to the gate terminal of switching element Q2.

Controlled power supply circuit 115 generates, from voltage V0, reference voltage VRef and power supply voltage VCC that is for use as power supply voltage for switching circuit 112, detection circuit 113, and control circuit 114. Controlled power supply circuit 115 includes diode D1, Zener diode ZD1, resistors R8, R9, and R10, and capacitors C3 and C4. Controlled power supply circuit 115 outputs, as power supply voltage VCC, a voltage corresponding to breakdown voltage of Zener diode ZD1. Reference voltage VRef is generated by dividing power supply voltage VCC by resistors R8 and R9.

[Operation of Lighting Fixture]

In the following, an operation of lighting fixture 100 according to the present embodiment is described. According to lighting fixture 100 of the present embodiment, as a user switches power switch 104 from on-state (on) to off-state (off) and back to on-state (on) in a short time, a light-emitting group to be turned on switches with another light-emitting group. In other words, the user can switch emission colors produced by lighting fixture 100 by operating power switch 104 twice in quick succession.

Figure 2:
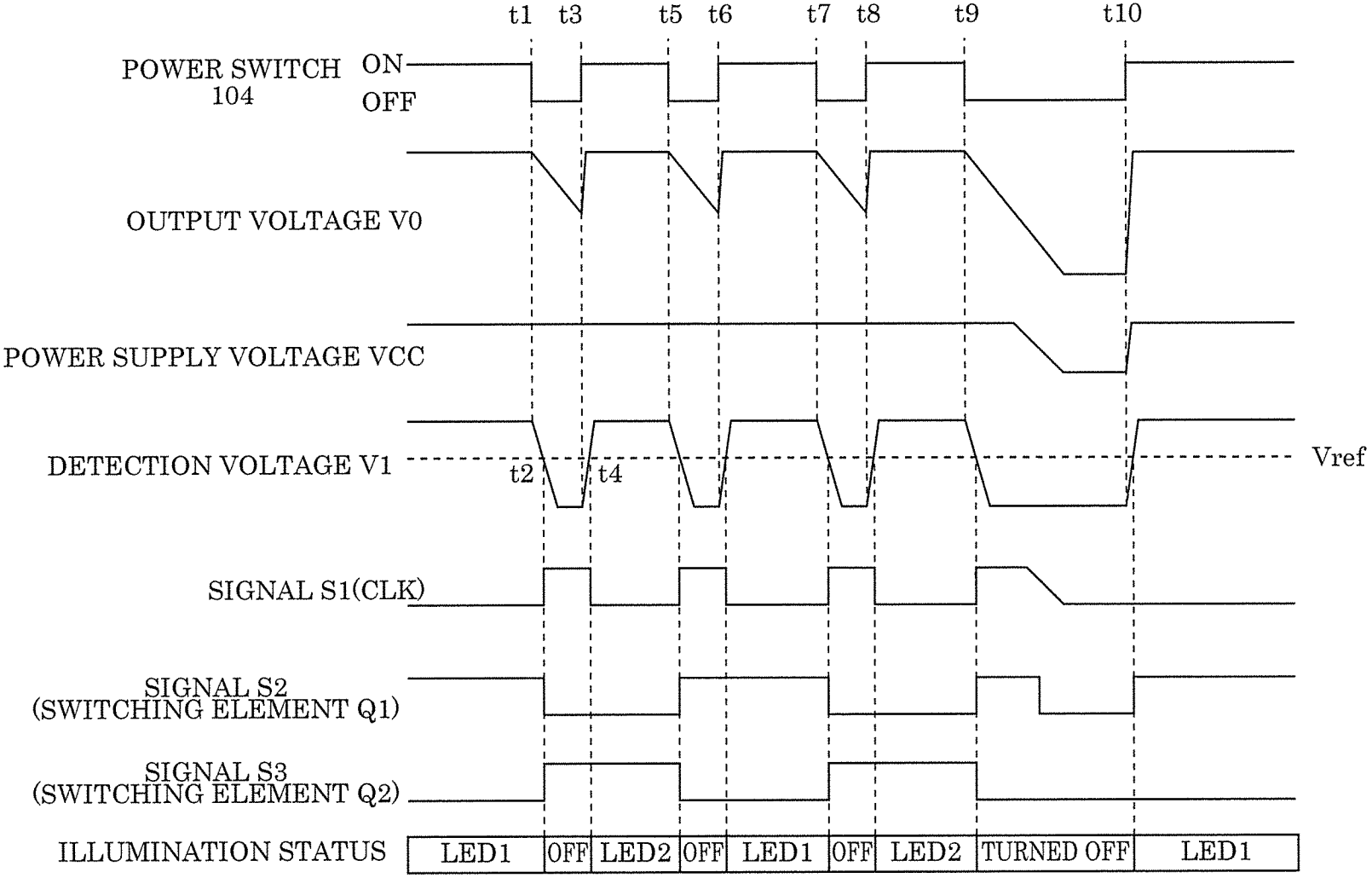
FIG. 2 is a timing diagram illustrating an operation of the lighting fixture according to Embodiment 1.

FIG. 2 is a timing diagram illustrating an operation of lighting fixture 100. In this example, signal S2 is high and signal S3 is low before time t1. For this reason, light-emitting group LED1 is on and light-emitting group LED2 is off. In this state, power switch 104 is turned off at time t1 and turned back on at time t3.

As power switch 104 is turned off at time t1, output of DC-power supply circuit 111 halts and voltage V0 at capacitor C1 gradually decreases. Along with the reduction of output voltage V0, current I0 through light-emitting elements 102 decreases as well, which reduces detection voltage V1. Note that the reduction of output voltage V0 is slight at this stage and thus power supply voltage VCC does not decrease. Thus, control circuit 114 operates as usual. In other words, control circuit 114 operates using residual charge at capacitors C1 and C3 once power switch 104 is turned off.

If detection voltage V1 is less than reference voltage VRef at time t2, signal S1 changes from low to high. This changes signal S2 from high to low, and signal S3 from low to high, thereby switching the light-emitting group to be supplied with current from light-emitting group LED1 to light-emitting group LED2.

Moreover, as power switch 104 is turned back on at time t3, DC-power supply circuit 111 starts outputting constant current and voltage V0 increases. This also increases current I0 through light-emitting elements 102, which increases detection voltage V1 as well.

As detection voltage V1 increases greater than reference voltage VRef at time t4, signal S1 changes from high to low, but flip flop FF1 maintains its state and output signals S2 and S3 remain unchanged.

As such, a light-emitting group to be turned on is switched by the user switching power switch 104 from on to off and back to on in a short time.

The same operation is carried out at time t5 to time t6 as well to switch the light-emitting group which is supplied with current from light-emitting group LED2 to light-emitting group LED1. Moreover, the operation at time t7 to t8 switches the light-emitting group which is supplied with current from light-emitting group LED1 to light-emitting group LED2.

Next, power switch 104 is turned off at time t9. In this case, the off-period during which power switch 104 is off is sufficiently long and voltage V0 thus decreases along with which power supply voltage VCC decreases. This ends up with control circuit 114 turning into inactive. Thus, control circuit 114 is reset when power switch 104 is turned on at time t10. This turns on a predetermined light-emitting group (light-emitting group LED1 in this example).

As such, if an off-period of power switch 104 is sufficiently long, control circuit 114 is reset and the predetermined light-emitting group is selected. Owing to this, when lighting fixtures 100 are connected to one power switch 104 and different light-emitting groups are selected in lighting fixtures 100, the user can cause the same light-emitting group to be selected in lighting fixtures 100 by turning off power switch 104 for a predetermined time or longer.

[Configuration Examples of DC-power Supply Circuit 111]

Figure 3:
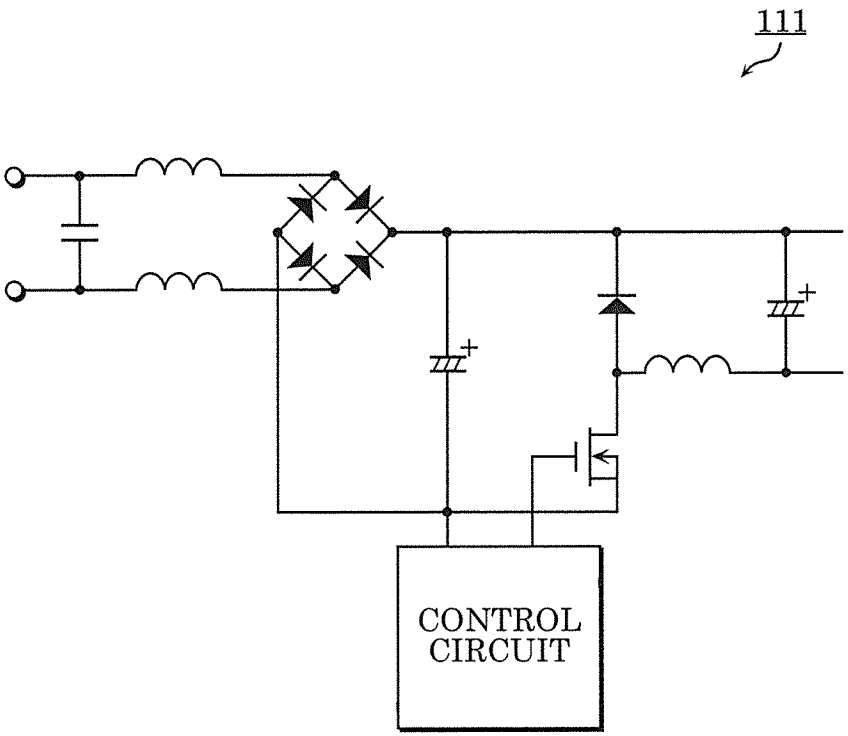
FIG. 3 is a diagram showing a configuration example of a DC-power supply circuit according to Embodiment 1.
Figure 4:
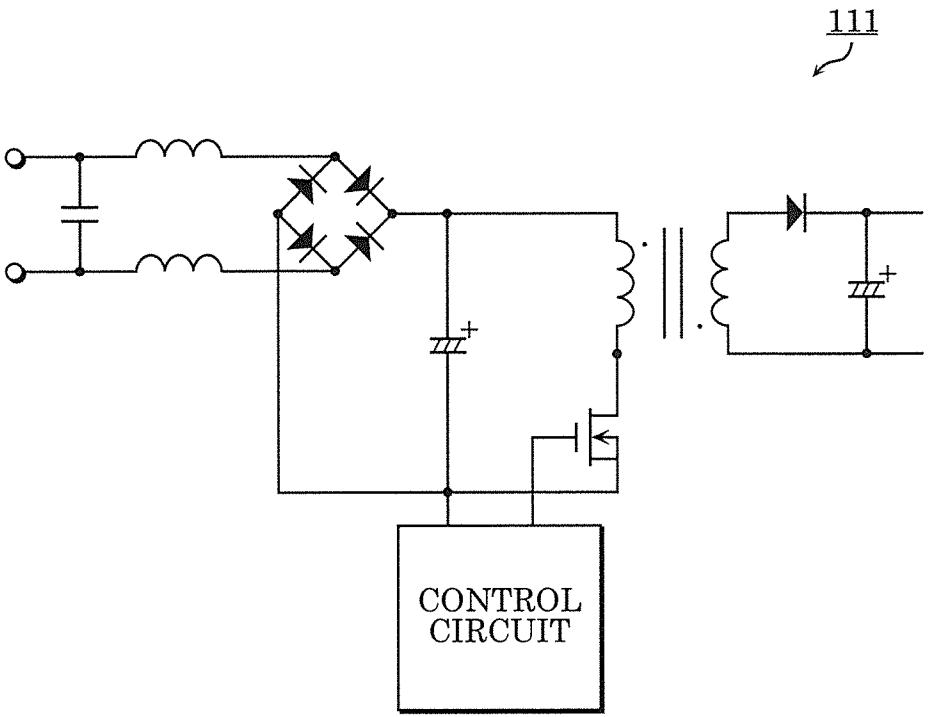
FIG. 4 is a diagram showing another configuration example of the DC-power supply circuit according to Embodiment 1.

FIGS. 3 and 4 are diagrams showing configuration examples of DC-power supply circuit 111. For example, a buck converter can be employed as DC-power supply circuit 111, as illustrated in FIG. 3. Alternatively, a flyback converter can be employed as DC-power supply circuit 111, as illustrated in FIG. 4.

Note that a buck-boost converter or a boost converter may be employed as DC-power supply circuit 111. Further, as DC-power supply circuit 111, a circuit which combines these converters may be employed or a circuit which combines a constant current circuit with these circuits may be employed.

[Variation 1]

Figure 5:
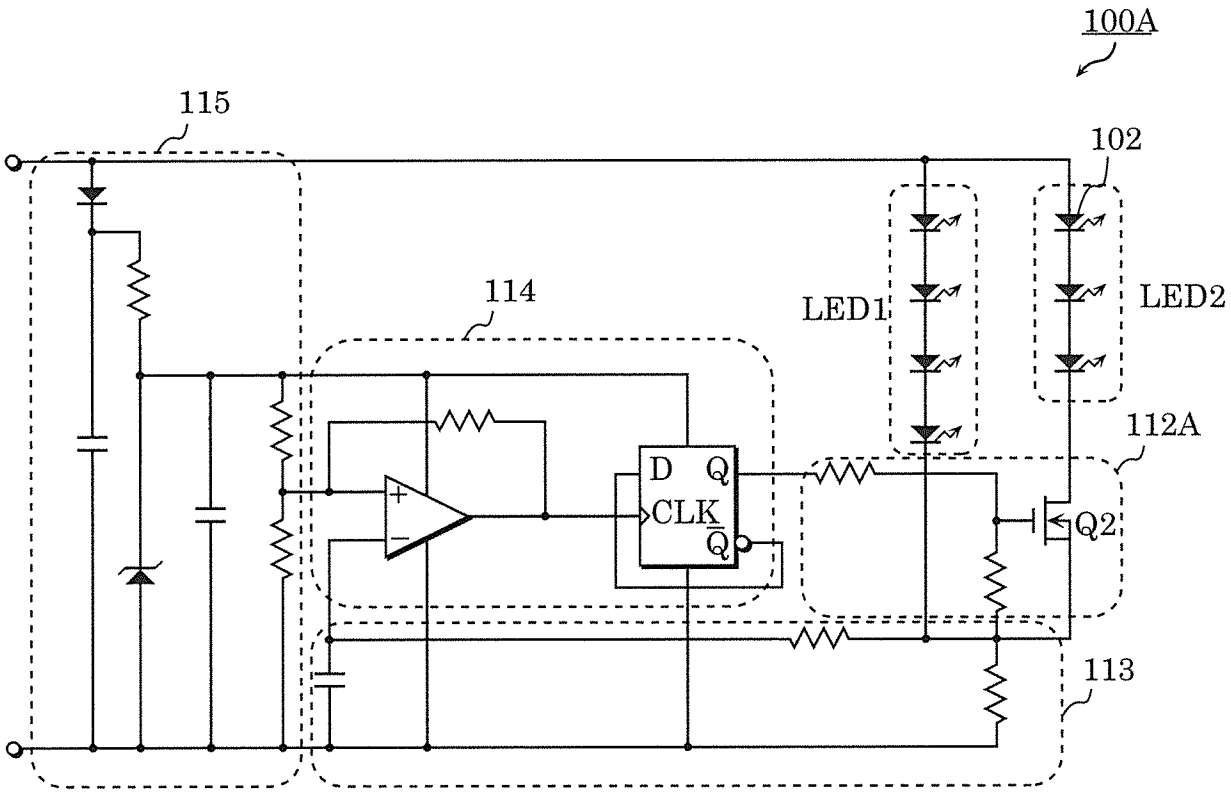
FIG. 5 is a diagram showing a configuration example of a lighting fixture according to Variation 1 of Embodiment 1.

FIG. 5 is a diagram showing a configuration example of lighting fixture 100A according to Variation 1 of the present embodiment. In lighting fixture 100A illustrated in FIG. 5, a total number of light-emitting elements 102 connected in series in light-emitting group LED1 is greater than a total number of light-emitting elements 102 connected in series in light-emitting group LED2. Moreover, switching circuit 112A includes only switching element Q2 that is connected to light-emitting group LED2 in series. In other words, no switching element is connected to light-emitting group LED1 in series.

In this case, during an on-period of switching element Q2, current flows through only light-emitting group LED2 that includes a less number of light-emitting elements 102 connected in series, that is, a smaller forward voltage than light-emitting group LED1, among light-emitting groups LED1 and LED2. On the other hand, during an off-period of switching element Q2, current flows through light-emitting group LED1 only.

Here, light-emitting groups LED1 and LED2 are different in luminous flux (brightness) since the number of light-emitting elements 102 included in light-emitting groups LED1 and LED2 are different. Thus, step-dimming can be achieved by causing light-emitting groups LED1 and LED2 to produce the same emission color. Moreover, emission color switching and step-dimming are achieved by causing light-emitting groups LED1 and LED2 to produce different emission colors.

According to this configuration, the total number of switching elements included in the configuration illustrated in FIG. 1 is reduced, thereby achieving cost reduction.

[Variation 2]

Figure 6:
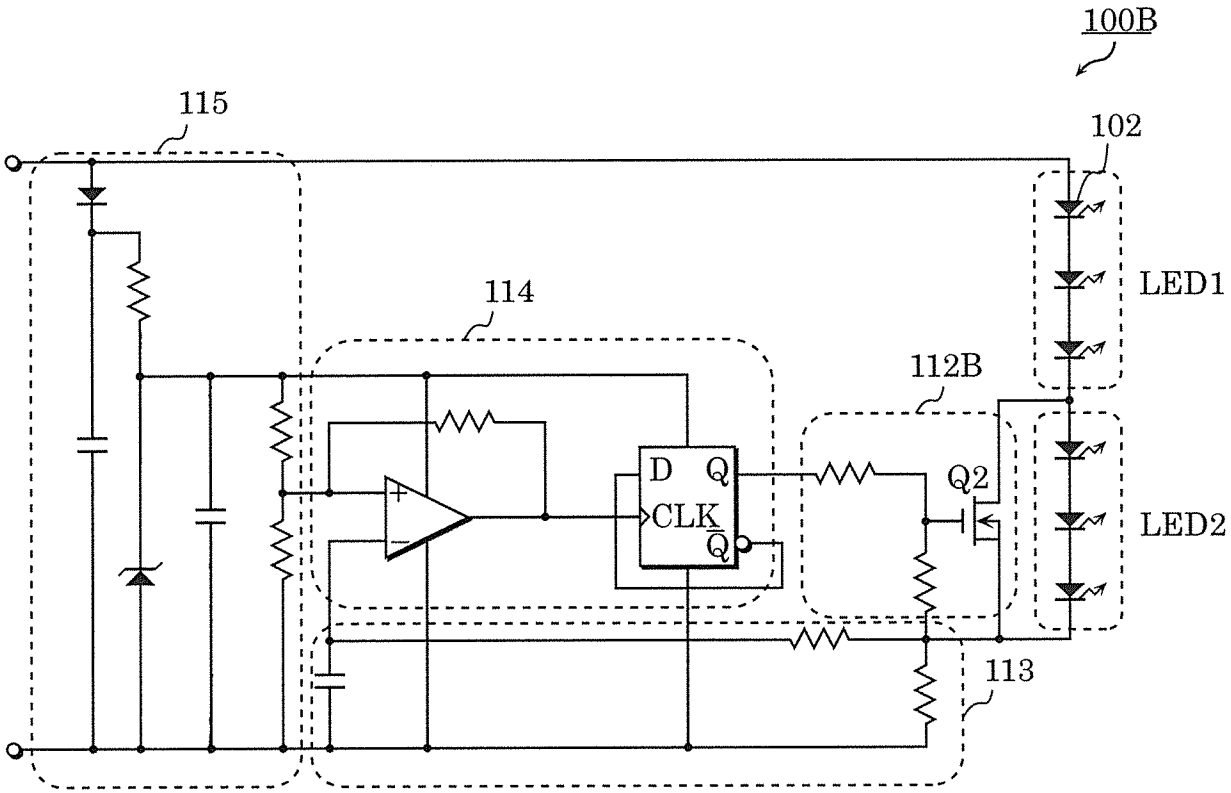
FIG. 6 is a diagram showing a configuration example of a lighting fixture according to Variation 2 of Embodiment 1.

FIG. 6 is a diagram showing a configuration example of lighting fixture 100B according to Variation 2 of the present embodiment. In lighting fixture 100B illustrated in FIG. 6, light-emitting group LED1 and light-emitting group LED2 are connected in series. Moreover, switching circuit 112B includes only switching element Q2 that is connected to light-emitting group LED2 in parallel.

In this case, current flows through both light-emitting groups LED1 and LED2 during an off-period of switching element Q2. On the other hand, current flows through light-emitting group LED1 only, during an on-period of switching element Q2.

Thus, step-dimming is achieved by causing light-emitting groups LED1 and LED2 to produce the same emission color.

[Variation 3]

Figure 7:
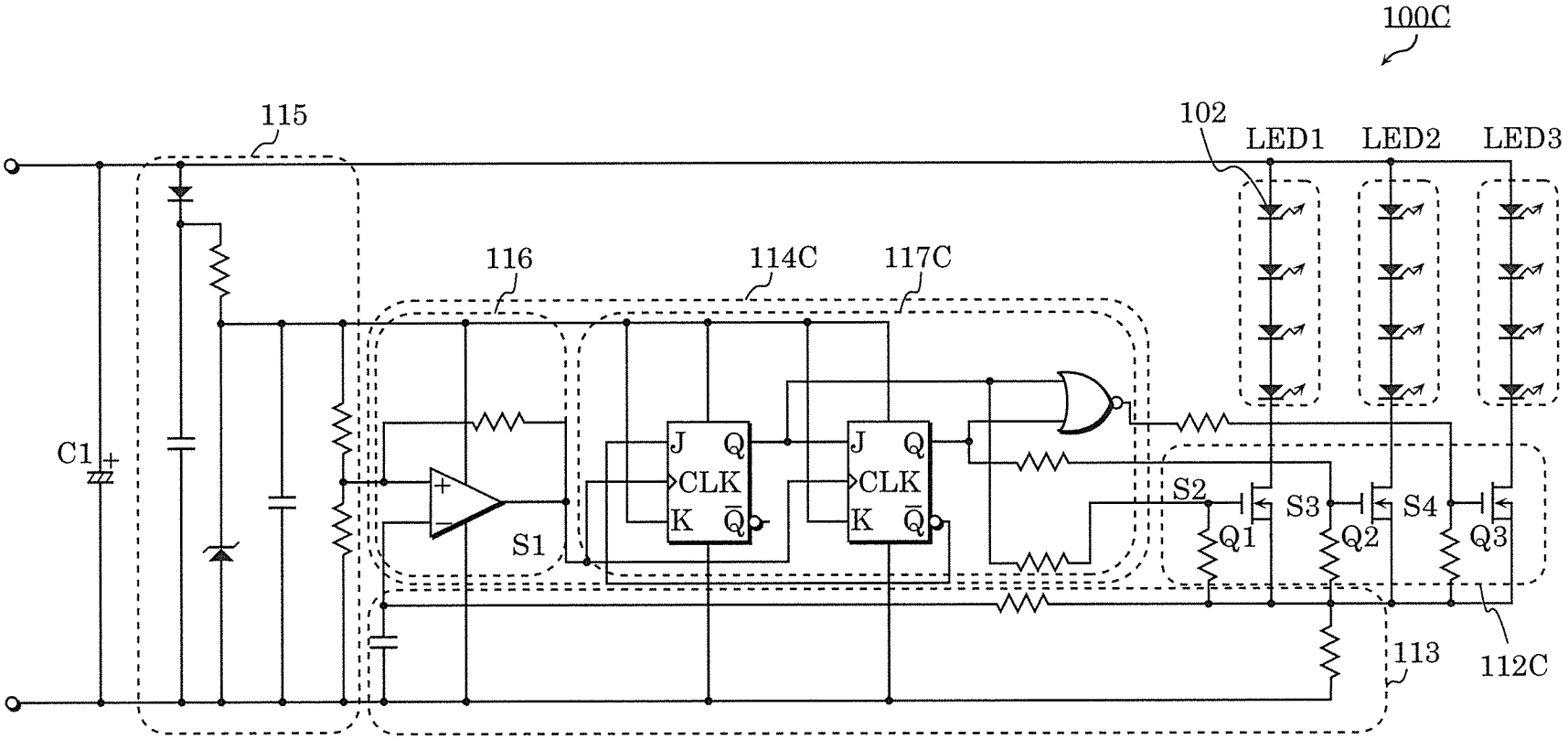
FIG. 7 is a diagram showing a configuration example of a lighting fixture according to Variation 3 of Embodiment 1.

Variation 3 of the present embodiment is described with reference to switching three light-emitting groups. FIG. 7 is a diagram showing a configuration example of lighting fixture 100C according to Variation 3 of the present embodiment. Lighting fixture 100C illustrated in FIG. 7 includes light-emitting groups LED1, LED2, and LED3. For example, light-emitting groups LED1, LED2, and LED3 are different in emission color.

Switching circuit 112C includes switching element Q1 connected to light-emitting group LED1 in series, switching element Q2 connected to light-emitting group LED2 in series, and switching element Q3 connected to light-emitting group LED 3 in series.

Figure 8:
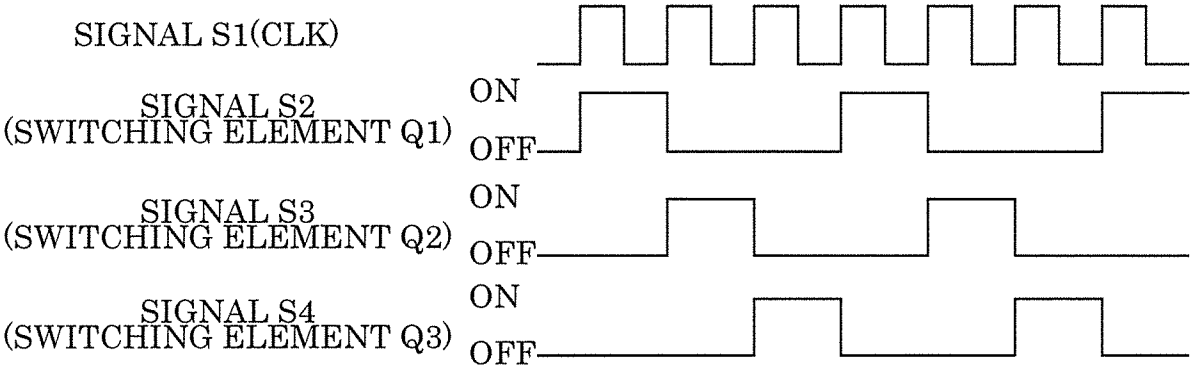
FIG. 8 is a timing diagram showing an operation of the lighting fixture according to Variation 3 of Embodiment 1.

Sequential circuit 117C included in control circuit 114C generates signals S2, S3, and S4 which turn on a corresponding one of switching elements Q1, Q2, and Q3, as illustrated in FIG. 8. Specifically, as illustrated in FIG. 8, a switching element to be turned on is switched at every rising edge of signal S1. This achieves implementation of three patterns of emission color switching. For example, sequential circuit 117C includes a JK flip flop and a NOR circuit, as illustrated in FIG. 7.

While Variation 3 has been described with reference to selecting one light-emitting group, it should be noted that two or three light-emitting groups may be selected simultaneously. In other words, implementation of up to eight patterns of emission color switching and up to eight combinations of step-dimming is achieved. Note that since it is obvious for a person skilled in the art to design the sequential circuit for achieving such functionalities, specific description is omitted.

Moreover, while Variation 3 has been described with reference to switching three light-emitting groups, four or more light-emitting groups may be switched.

[Variation 4]

Figure 9:
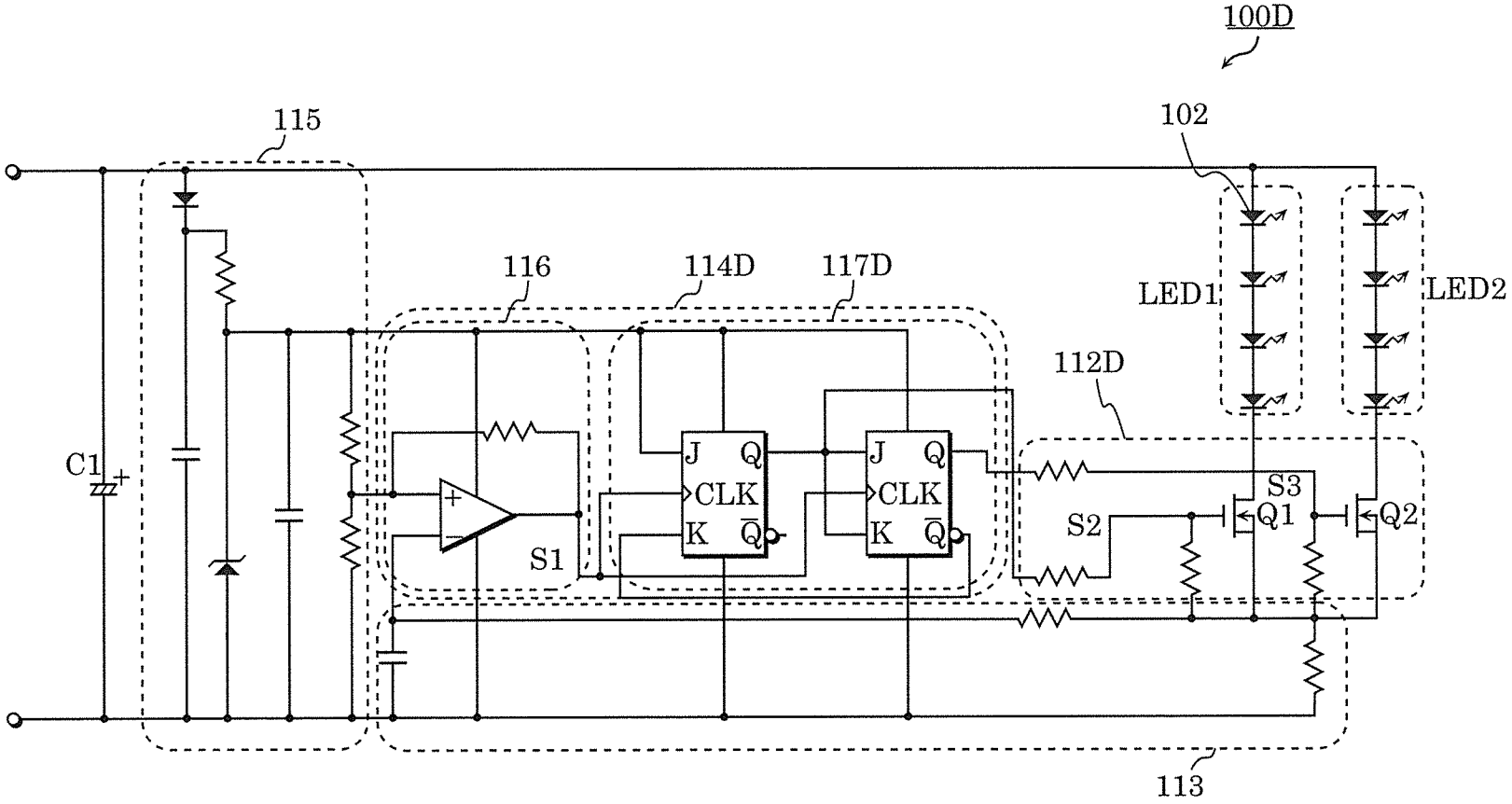
FIG. 9 is a diagram showing a configuration example of a lighting fixture according to Variation 4 of Embodiment 1.

FIG. 9 is a diagram showing a configuration example of lighting fixture 100D according to Variation 4 of the present embodiment. Lighting fixture 100D illustrated in FIG. 9 includes light-emitting groups LED1 and LED2. For example, light-emitting groups LED1 and LED2 are different in emission color.

Switching circuit 112D includes switching element Q1 connected to light-emitting group LED1 in series, and switching element Q2 connected to light-emitting group LED2 in series.

Figure 10:
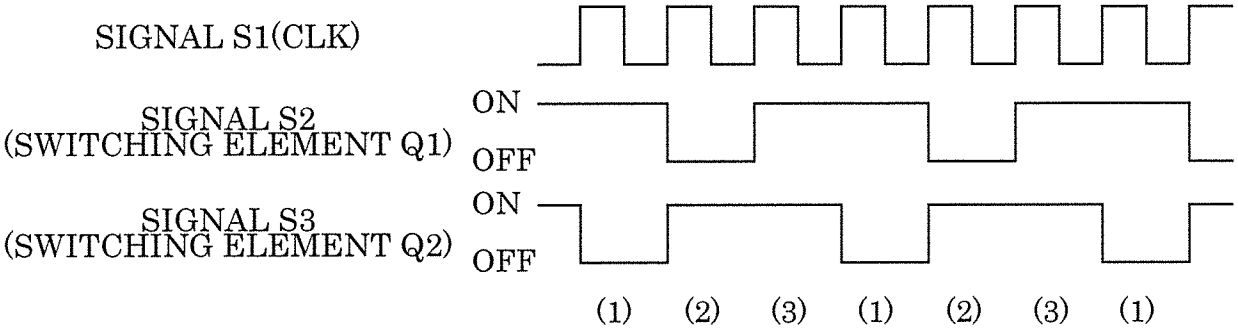
FIG. 10 is a timing diagram showing an operation of the lighting fixture according to Variation 4 of Embodiment 1.

Sequential circuit 117D included in control circuit 114D generates signals S2 and S3 which (1) turn on switching element Q1 only, (2) turn on switching element Q2 only, or (3) turn on both switching elements Q1 and Q2, among switching elements Q1 and Q2, as illustrated in FIG. 10. Specifically, as illustrated in FIG. 10, a switching element to be turned on is switched at every rising edge of signal S1. This achieves implementation of three patterns of emission color switching. For example, if emission colors produced by light-emitting groups LED1 and LED2 are 2700 K and 5000 K, respectively, implementation of three patterns of emission color switching, (1) 2700 K, (2) 5000 K, and (3) 3850 K is achieved.

While Variation 4 has been described with reference to switching two light-emitting groups, it should be noted that three or more light-emitting groups may be switched as well.

[Variation 5]

Figure 11:
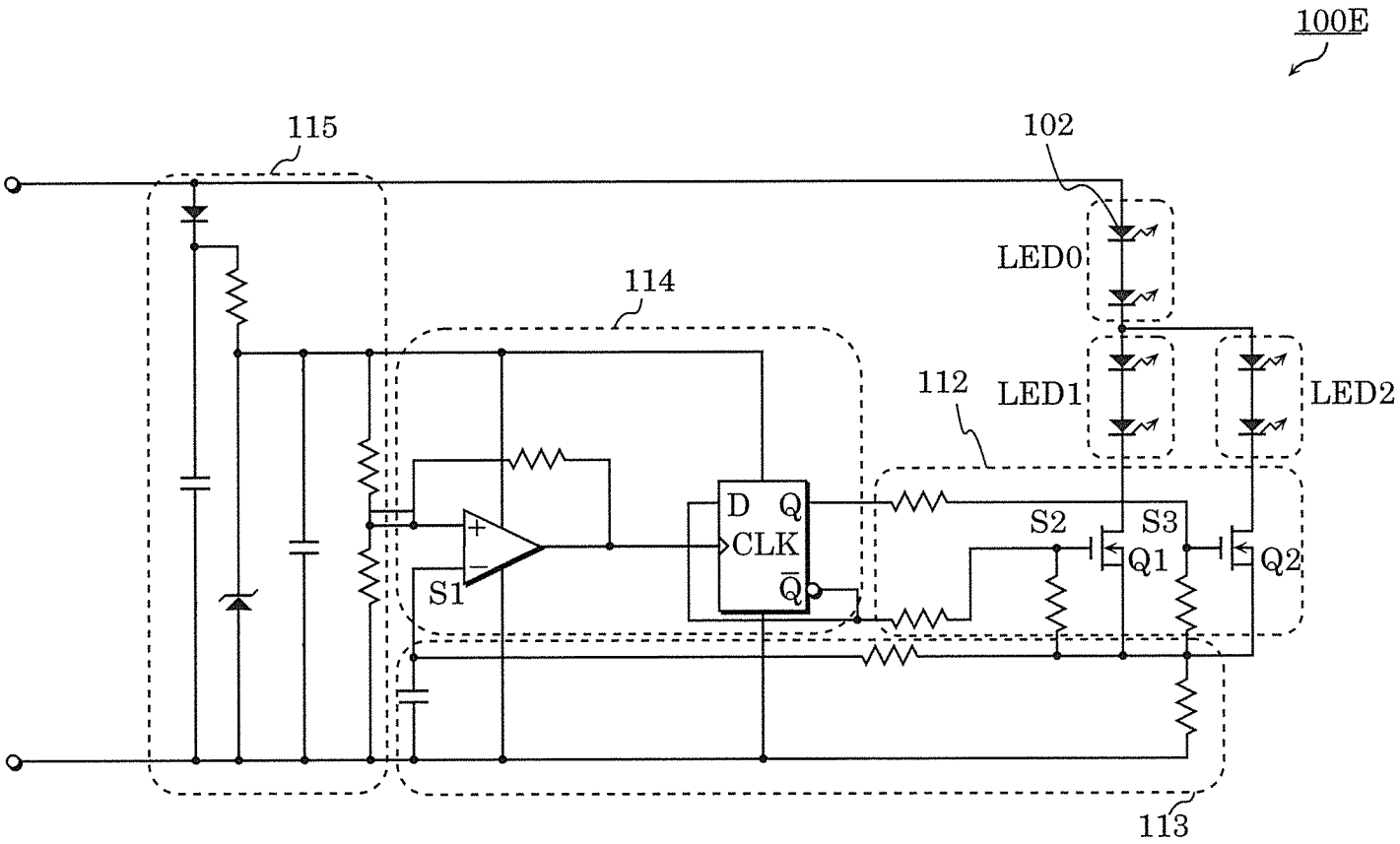
FIG. 11 is a diagram showing a configuration example of a lighting fixture according to Variation 5 of Embodiment 1.

FIG. 11 is a diagram showing a configuration example of lighting fixture 100E according to Variation 5 of the present embodiment. Lighting fixture 100E included in FIG. 11 includes light-emitting groups LED0, LED1, and LED2. For example, light-emitting groups LED0, LED1, and LED2 are different in emission color.

Switching element Q1 is connected to light-emitting groups LED0 and LED1 in series, and switching element Q2 is connected to light-emitting groups LED0 and LED2 in series. Control circuit 114 turns on one of switching elements Q1 and Q2.

During an on-period of switching element Q1, light-emitting groups LED0 and LED1 emit light to achieve a first intermediate color between light-emitting groups LED0 and LED1. During an on-period of switching element Q2, light-emitting groups LED0 and LED2 emit light to achieve a second intermediate color between light-emitting groups LED0 and LED2. For example, if emission colors produced by light-emitting groups LED0, LED1, and LED2 are 4000 K, 2000 K, and 6000 K, respectively, the first intermediate color is 3000 K and the second intermediate color is 5000 K.

According to this configuration, a total number of light-emitting elements 102 can be reduced less than the configuration illustrated in FIG. 1, thereby achieving cost reduction.

[Variation 6]

Figure 12:
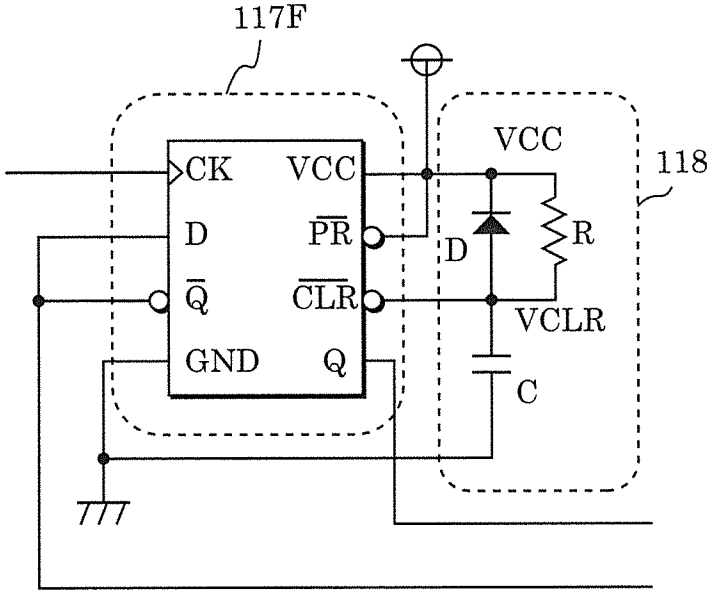
FIG. 12 is a diagram showing a configuration example of a reset circuit according to Variation 6 of Embodiment 1.

Any of the lighting fixtures described above may include a power-on reset circuit (or power-on preset circuit) for reliably resetting the sequential circuit. FIG. 12 is a diagram showing configuration examples of sequential circuit 117F and reset circuit 118 according to Variation 6 of the present embodiment. Sequential circuit 117F is, for example, sequential circuit 117 described above.

Reset circuit 118 includes resistor R, diode D, and capacitor C. Resistor R and diode D are connected between a VCC terminal and a CLR bar terminal of sequential circuit 117F. Capacitor C is connected to the CLR bar terminal.

Figure 13:
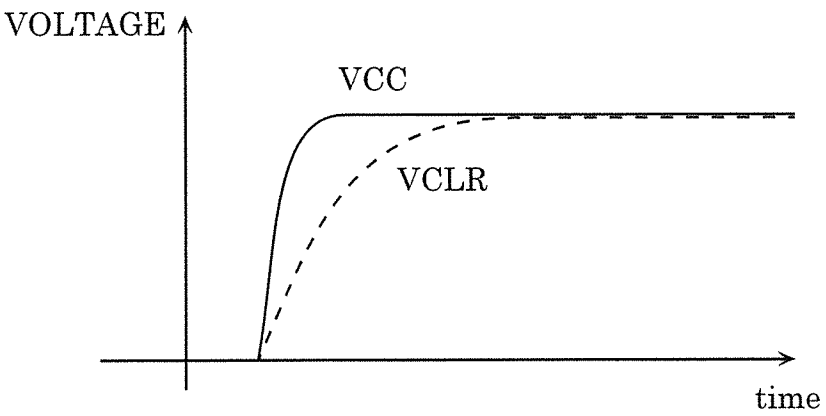
FIG. 13 is a diagram illustrating an operation of the reset circuit according to Variation 6 of Embodiment 1.

FIG. 13 is a diagram illustrating an operation of reset circuit 118. Voltage VCLR input to the CLR bar terminal rises later than voltage VCC from the VCC terminal due to effects of resistor R and capacitor C, as illustrated in FIG. 13. This determines the CLR bar terminal to be low at power-up, thereby causing sequential circuit 117F to be reset.

Embodiment 2

In order to achieve the operation of switching a light-emitting element to be caused to emit light by continuously switching a power switch, such as a wall switch, from on to off and back to on, a controller, which controls the switching of the light-emitting element, needs to operate even when the power switch is temporally off. In response, the technology disclosed in PTL1 includes a dedicated microcomputer power supply for the controller (microcomputer). The dedicated microcomputer power supply is independent of a DC-power supply circuit that supplies power to light-emitting elements. However, problems, such as an increase of cost, occur in this case.

On the other hand, it is also contemplated that the controller is operated using the power from the DC-power supply circuit. In this case, however, when the power switch is turned off, the power supplied to the controller is interrupted as well, thereby causing a reduction of operation stability.

Thus, a lighting device or a lighting fixture which improves operation stability is described in the present embodiment.

In the present embodiment, a lighting fixture is described which includes a power-on reset circuit (or power-on preset circuit) for reliably resetting the sequential circuit. While a variation of lighting fixture 100 illustrated in FIG. 1 is described in the following, it should be noted that the same modification is applicable to the lighting fixture described in the above variations as well.

[Configuration of Lighting Fixture]

Figure 14:
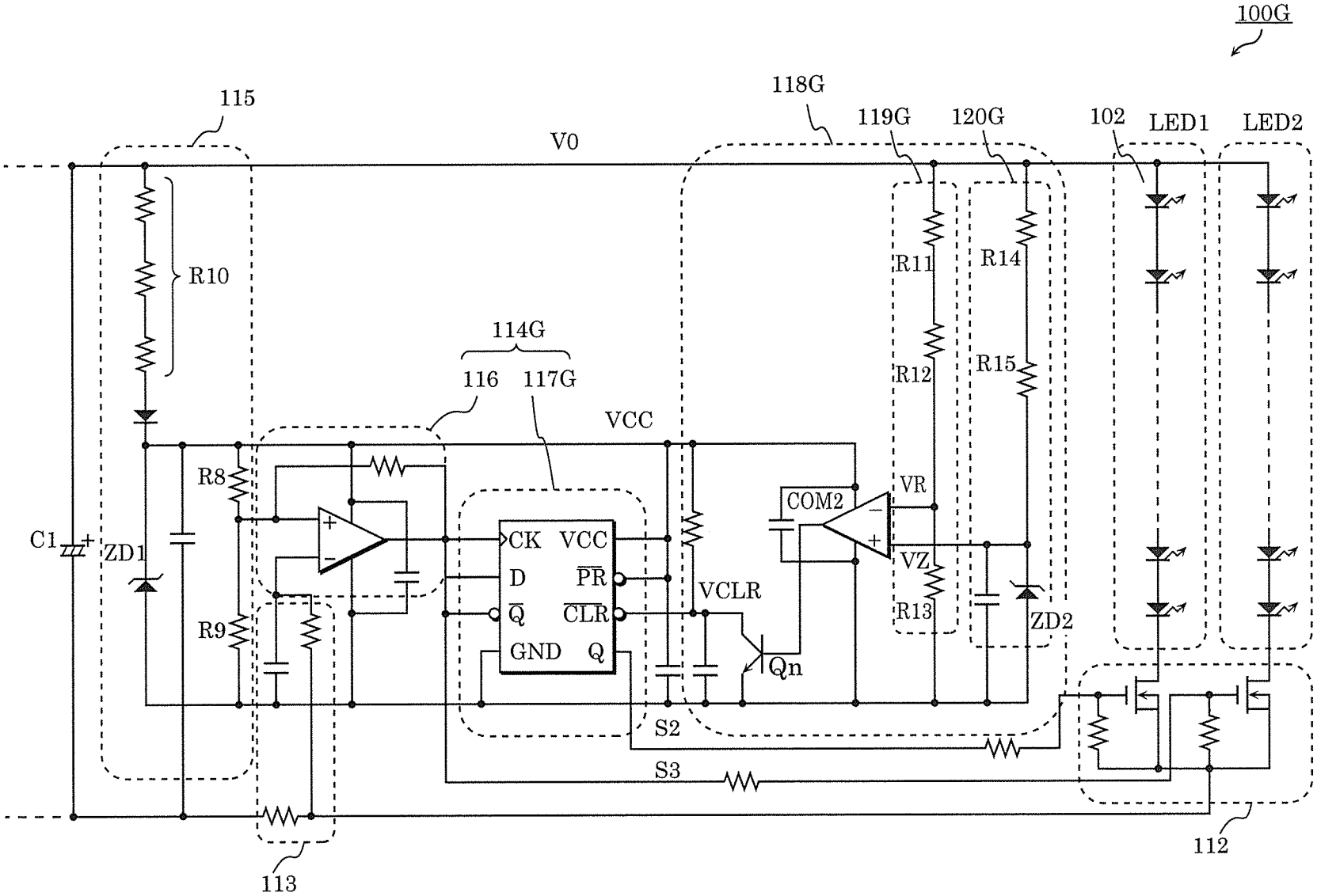
FIG. 14 is a diagram showing a configuration example of a lighting fixture according to Embodiment 2 of the present disclosure.

FIG. 14 is a diagram showing a configuration example of lighting fixture 100G according to the present embodiment. Lighting fixture 100G illustrated in FIG. 14 is the same as lighting fixture 100 illustrated in FIG. 1, except for the configuration of sequential circuit 117G included in control circuit 114G. Moreover, lighting fixture 100G includes reset circuit 118G for resetting control circuit 114G.

Sequential circuit 117G includes a flip flop having a clear terminal (CLR bar terminal). Sequential circuit 117G is reset when the clear terminal changes to low, thereby outputting signals S2 and S3 having predetermined logic values. In other words, control circuit 114G controls switching circuit 112 so that one or more predetermined light-emitting elements 102 (light-emitting group) among light-emitting elements 102 are selected as light-emitting elements 102 to be supplied with current I0 when control circuit 114G is reset.

Reset circuit 118G resets control circuit 114G (flip flop included in sequential circuit 117G) if voltage V0 (first voltage) decreases less than a predetermined voltage value. Voltage V0 is output voltage of DC-power supply circuit 111 and voltage at capacitor C1. Reset circuit 118G includes first voltage generating circuit 119G, second voltage generating circuit 120G, comparator COM2, and bipolar transistor Qn.

First voltage generating circuit 119G generates, from voltage V0, voltage VR (second voltage) which changes in proportional to a change in voltage V0. Specifically, first voltage generating circuit 119G includes resistors R11, R12, and R13. Voltage VR is generated by dividing voltage V0 by resistors R11 and R12 and resistor R13.

Second voltage generating circuit 120G generates, from voltage V0, reference voltage VZ which is constant and does not follow a change in voltage V0. Specifically, second voltage generating circuit 120G includes resistors R14 and R15, and Zener diode ZD2 which is a constant voltage generating element. Second voltage generating circuit 120G outputs voltage corresponding to a breakdown voltage of Zener diode ZD2, as reference voltage VZ.

Here, voltage VR is greater than reference voltage VZ in normal operation where power switch 104 is on, and reduces along with a reduction of voltage V0 in an off-state of power switch 104.

Comparator COM2 compares voltage VR with reference voltage VZ and outputs a signal indicating a result of the comparison. Bipolar transistor Qn amplifies the output signal of comparator COM2, thereby generating signal VCLR. Specifically, as the output signal of comparator COM2 changes to high, bipolar transistor Qn changes to on-state and the clear terminal (signal VCLR) changes to low.

According to this configuration, reset circuit 118G resets control circuit 114G (sequential circuit 117G) if voltage VR decreases less than reference voltage VZ.

[Reset Operation]

Figure 15:
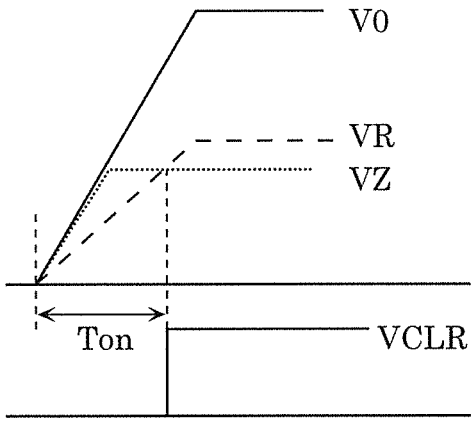

FIG. 15 is a diagram illustrating an operation of reset circuit 118G upon power-on. As illustrated in FIG. 15, signal VCLR is low until the elapse of time Ton since power-on, thereby resetting control circuit 114G. Signal VCLR rises after the elapse of time Ton since power-on, thereby releasing control circuit 114G from the reset state. This allows control circuit 114G to be reset reliably during a low-voltage state upon power-on, thereby inhibiting malfunction of control circuit 114G and allowing the predetermined light-emitting group to be selected reliably. For example, time Ton is about several tens of milliseconds to about a few seconds.

Figure 16:
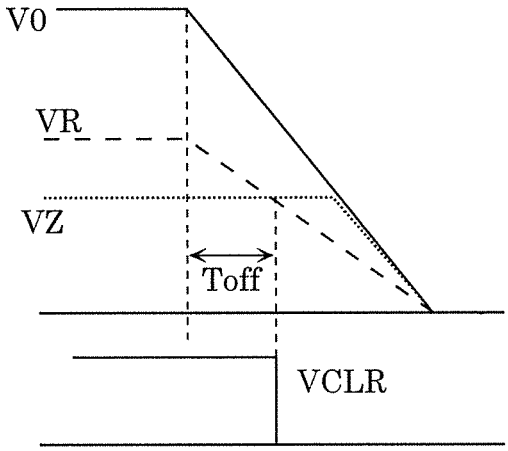
FIG. 16 is a diagram illustrating an operation of the reset circuit according to Embodiment 2 upon power-off.

FIG. 16 is a diagram illustrating an operation of reset circuit 118G upon power-off. As illustrated in FIG. 16, signal VCLR changes to low after the elapse of time Toff since power-off, thereby resetting control circuit 114G. This allows control circuit 114G to be reset reliably upon power-on, thereby inhibiting malfunction of control circuit 114G. If the power is turned on before the elapse of time Toff since power-off, control circuit 114G is not reset and the operation of switching between the light-emitting groups as described above is carried out. For example, time Toff is about a few seconds to about several tens of seconds. Time Toff can be adjusted by adjusting the capacitance value of capacitor C1 and a time constant due to power consumption by the circuit.

Note that control circuit 114G needs to be in operation until being reset. In other words, preferably, voltage VCC does not decrease less than a minimum working voltage of control circuit 114G until the elapse of time Toff. Thus, reference voltage VZ needs to be greater than the minimum working voltage of control circuit 114G.

According to the above configuration, lighting fixture 100G according to the present embodiment reliably resets control circuit 114G upon power-on, using reset circuit 118G which compares voltage VR, which changes along with a change in voltage V0, with reference voltage VZ, thereby improving the operation stability.

[Variation 1]

Figure 17:
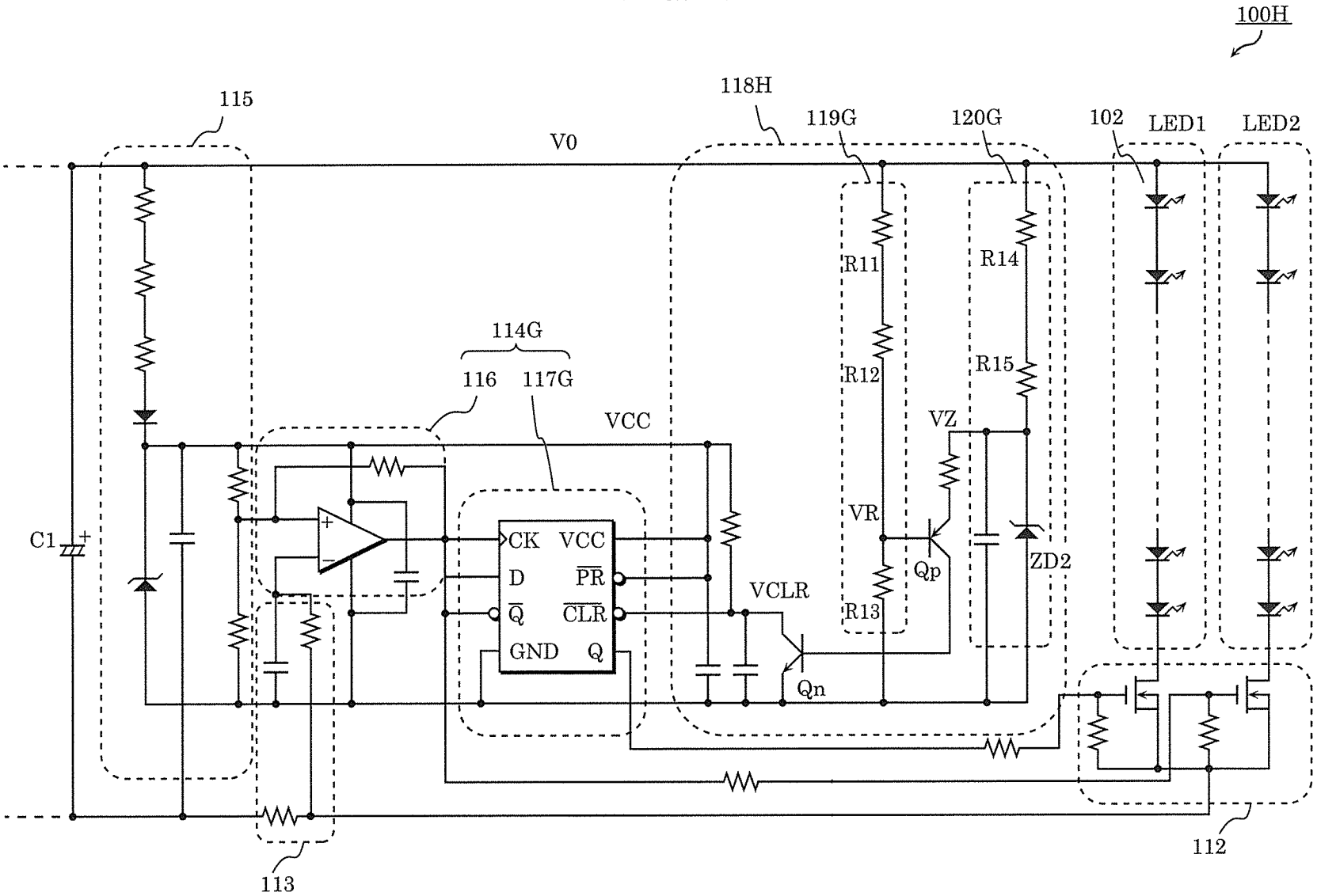
FIG. 17 is a diagram showing a configuration example of a lighting fixture according to Variation 1 of Embodiment 2.

FIG. 17 is a diagram showing a configuration example of lighting fixture 100H according to Variation 1 of the present embodiment. Lighting fixture 100H illustrated in FIG. 17 is the same as lighting fixture 100G illustrated in FIG. 14, except for the configuration of reset circuit 118H. Specifically, reset circuit 118H includes bipolar transistor Qp, instead of comparator COM2.

Bipolar transistor Qp is a PNP transistor, and has the base to which voltage VR is applied and the emitter to which reference voltage VZ is applied. Bipolar transistor Qp turns on if reference voltage VZ is less than voltage VR. Turning on of bipolar transistor Qn changes signal VCLR to low and resets control circuit 114G. In other words, control circuit 114G is reset based on a voltage at the collector of bipolar transistor Qp.

Operation same as the configuration illustrated in FIG. 14 can be achieved in this configuration as well. Moreover, this can simplify the circuitry of the configuration illustrated in FIG. 14, thereby achieving cost reduction.

[Variation 2]

Figure 18:
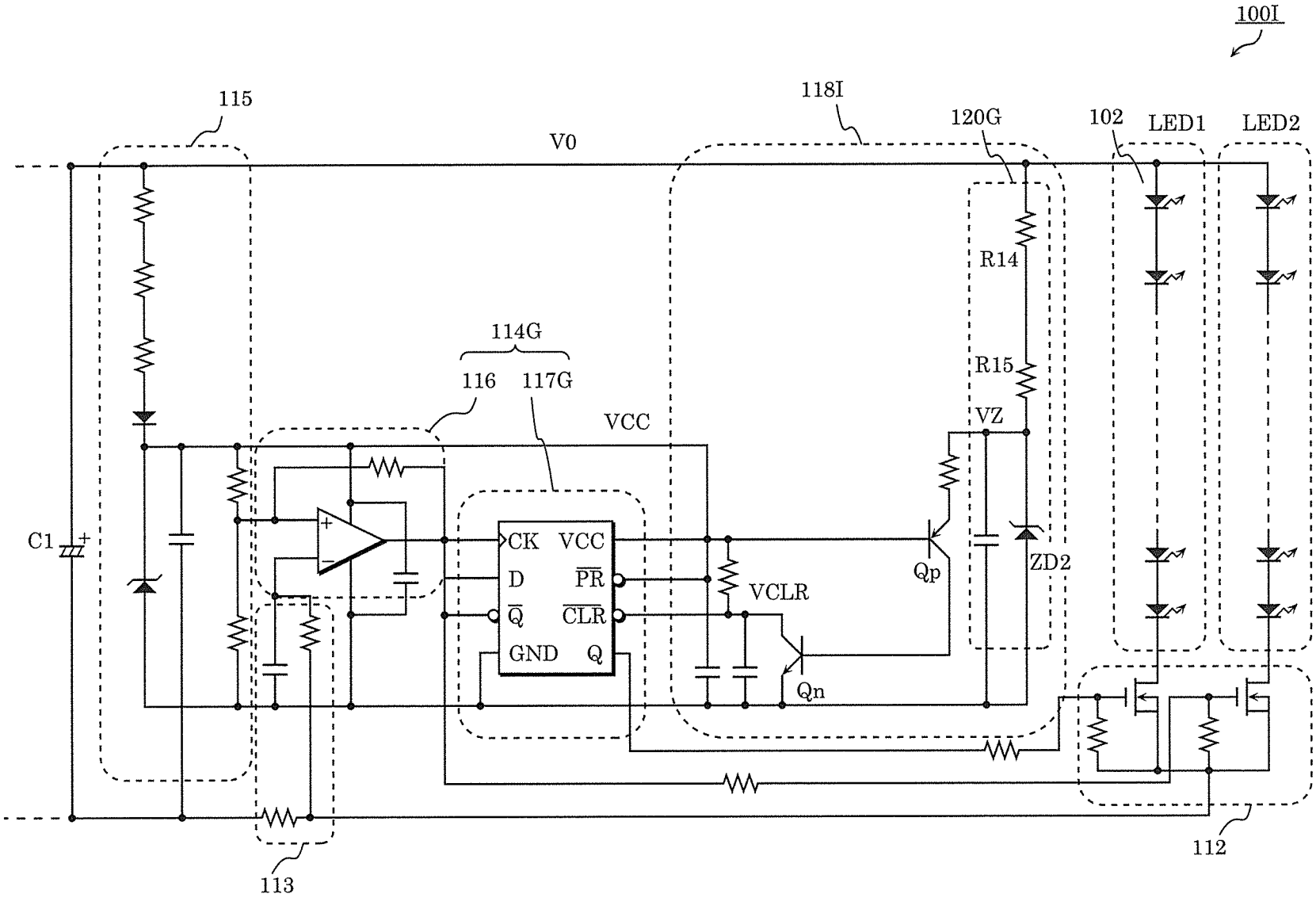
FIG. 18 is a diagram showing a configuration example of a lighting fixture according to Variation 2 of Embodiment 2.

FIG. 18 is a diagram showing a configuration example of lighting fixture 100I according to Variation 2 of the present embodiment. Lighting fixture 100I illustrated in FIG. 18 is the same as lighting fixture 100H illustrated in FIG. 17, except that voltage VCC is used instead of voltage VR. Specifically, reset circuit 118I does not include first voltage generating circuit 119G. Moreover, voltage VCC is applied to the base of bipolar transistor Qp. In other words, the function of first voltage generating circuit 119G is implemented by resistors R8, R9, and R10 included in controlled power supply circuit 115.

Figure 19:
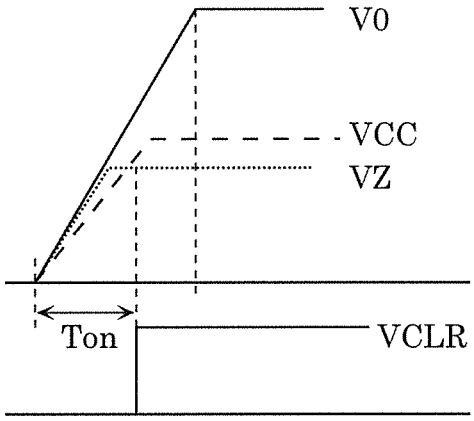
Figure 20:
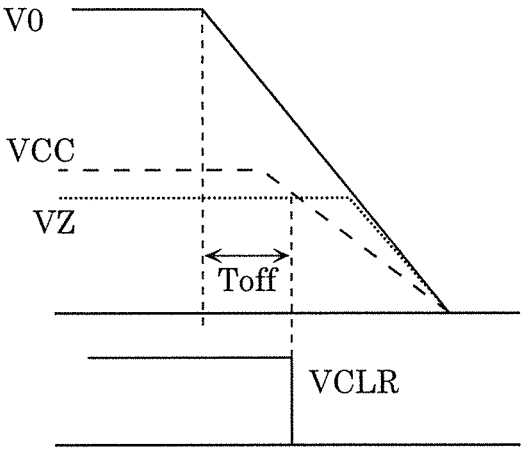
FIG. 20 is a diagram illustrating an operation of the reset circuit according to Variation 2 of Embodiment 2 upon power-off.

FIG. 19 is a diagram illustrating an operation of reset circuit 118I upon power-on. FIG. 20 is a diagram illustrating an operation of reset circuit 118I upon power-off. As illustrated in FIGS. 19 and 20, operation same as illustrated in FIGS. 15 and 16 can be achieved. Note that effects of the breakdown voltage of Zener diode ZD1 are dominant in an area where voltage V0 is high, and voltage VCC is a constant voltage based on the breakdown voltage. On the other hand, in an area where voltage V0 is low, that is, an area where a voltage obtained by dividing voltage V0 by resistors R8 and R9 and resistor 10 is equal to or less than the breakdown voltage, effects of resistors R8 and R9 and resistor 10 are dominant and voltage VCC decreases along with a reduction of voltage V0. As such, as with voltage VR, voltage VCC in normal operation where power switch 104 is on is greater than reference voltage VZ, and reduces along with a reduction of voltage V0 in an off-state of power switch 104.

While the above description has been set forth with reference to changing the clear terminal of the flip flop to low to reset control circuit 114G, a preset terminal may be changed to low.

[One Example of Lighting Fixture]

Figure 21:
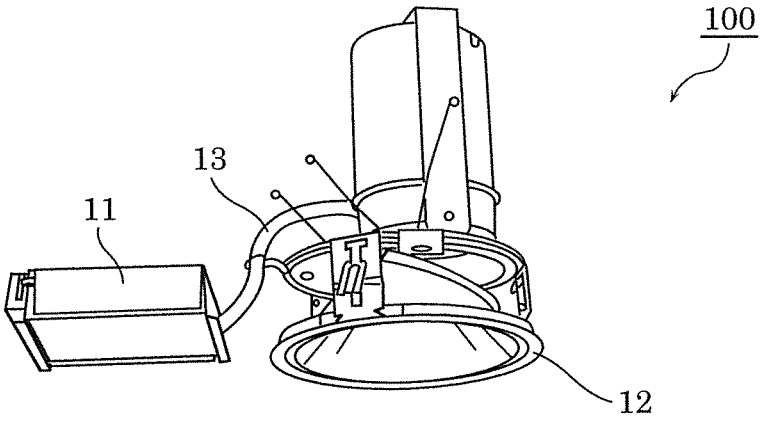
FIG. 21 is a schematic view of an appearance of the lighting fixture according to Embodiments 1 and 2.

FIG. 21 is an external view of lighting fixture 100, etc. described in the above embodiments. FIG. 21 illustrates an example in which lighting fixture 100 is applied to a downlight. Lighting fixture 100 includes circuit box 11, lamp 12, and line 13.

Circuit box 11 accommodates lighting device 101 described above, and an LED (light-emitting elements 102) is attached to lamp 12. Line 13 electrically connects circuit box 11 and lamp 12.

Note that lighting fixture 100 may be applied to other lighting fixtures, such as a spotlight.

[Other Variations]

DC-power supply circuit 111 may carry out a dimming operation. In other words, DC-power supply circuit 111 may selectively output any of different constant current values.

The light-emitting groups each may include one or more light-emitting elements 102. Moreover, if a light-emitting group includes two or more light-emitting elements 102, light-emitting elements 102 may be connected in series or connected in parallel, or series connection and parallel connection may be combined A different light distribution may be produced when a different light-emitting group is selected.

The configuration of detection circuit 113 is not limited to the configuration using resistor R5 as described above. For example, in the case where DC-power supply circuit 111 which carries out the dimming operation is used, the resistance value of resistor R5 needs to be great to detect a small current. For example, detection circuit 113 may further include a diode that is connected to resistor R5 in parallel. This allows detection of small current and also allows a reduction of loss when large current flows through detection circuit 113.

In the above, the configuration of detecting the output current of DC-power supply circuit 111 has been described above. However, output voltage of DC-power supply circuit 111 may be detected. This allows highly accurate detection of a change in voltage, as compared to detecting the voltage by detecting a current as described above.

Control circuit 114 and detection circuit 113 may each be configured of a microcomputer, a field programmable gate array (FPGA), or a programmable logic device (PLD), for example.

The switching elements are not limited to MOSFETs. For example, the switching elements may be bipolar transistors, insulated gate bipolar transistors (IGBT), or relays, for example.

Moreover, at least some of the processing units included in the lighting fixture or the lighting device according to the above embodiments are typically implemented in LSIs which are integrated circuits. These processing units may separately be mounted on one chip, or a part or the whole of the processing units may be mounted on one chip.

Moreover, the divisions of the circuit blocks in the circuit diagrams, etc, are by way of example. Two or more of the circuit blocks may be implemented in one circuit block, one circuit block may be divided into circuit blocks, or part of the functionality of a circuit block may be moved to another circuit block. For example, in FIG. 1, etc., resistors R8 and R9 may be included in comparison circuit 116.

Moreover, the circuitry illustrated in the circuit diagrams above is one example, and the present disclosure is not limited to the above circuitry. In other words, as with the circuitry, circuits which can implement the characteristic features of the present disclosure are also included in the present disclosure. For example, a certain element having an element, such as a switching element (transistor), a resistance element, or a capacitor element, connected thereto in series or in parallel is also included in the present disclosure to an extent that can achieve functionality same as the functionality of the circuitry described above. In other words, "connected" as used in the above embodiments is not limited to two terminals (nodes) being connected directly, and includes the two terminals (nodes) being connected via an element to an extent that can achieve the same functionality.

Moreover, the logic levels represented by high/low or the switching states represented by on/off are illustration for specifically describing the present disclosure. Different combinations of the logic levels or the switching states illustrated can also achieve equivalent result. Furthermore, the configuration of the logic circuit shown above is illustration for specifically describing the present disclosure. A different logic circuit can also achieve an equivalent input and output relation.

While the lighting device and the lighting fixture according to one or more aspects of the present disclosure have been described with reference to the embodiments, the present disclosure is not limited to the embodiments. Various modifications to the embodiments that may be conceived by a person skilled in the art or combinations of the components of different embodiments are intended to be included within the scope of the one or more aspects of the present disclosure, without departing from the spirit of the present disclosure.

What is claimed is:

1. A lighting device configured to be connected to a power switch and supply a plurality of light-emitting elements with current, the lighting device comprising:

a DC-power supply circuit configured to supply the plurality of light-emitting elements with the current when the power switch is turned on;

a switching circuit for switching which light-emitting element or light-emitting elements from among the plurality of light-emitting elements is supplied with the current;

a detection circuit which detects the current supplied to the plurality of light-emitting elements; and a control circuit operatively coupled to the detection circuit to detect the current supplied to the plurality of light emitting elements changing from an on value to an off value, less than the on value, and back to the on value caused by the power switch being turned from on to off and back to on within a predefined period, the control circuit being configured to control the switching circuit to switch through which of the light-emitting element or light-emitting elements from among the plurality of light-emitting elements the current flows in response to detecting the current supplied to the plurality of light emitting elements changing from the on value to the off value and back to the on value caused by the power switch being turned from on to off and back to on within a predefined period.

2. The lighting device according to claim 1, wherein the plurality of light-emitting elements are arranged in a plurality of light-emitting groups, and the control circuit controls the switching circuit to switch through which of the light-emitting element or light-emitting elements from among the plurality of light-emitting elements the current flows on a group-by-group basis among the plurality of light-emitting groups.

3. The lighting device according to claim 2, wherein the plurality of light-emitting groups include a first light-emitting group, wherein an emission color produced by a light-emitting element included in the first light-emitting group is different from an emission color produced by a light-emitting element included in another light-emitting group among the plurality of light-emitting groups.

4. The lighting device according to claim 2, wherein the plurality of light-emitting groups include a first light-emitting group and a second light-emitting group, wherein a total number of light-emitting elements connected in series in the first light-emitting group is greater than a total number of light-emitting elements connected in series in the second light-emitting group, and the switching circuit includes a switching element connected to the second light-emitting group in series, whereas there is not a switching element connected to the first light-emitting group in series.

5. The lighting device according to claim 2, wherein the plurality of light-emitting groups include a first light-emitting group and a second light-emitting group which are connected in series, and the switching circuit includes a switching element connected to the second light-emitting group in parallel.

6. The lighting device according to claim 1, wherein the detection circuit converts the current through the light-emitting element into a detection voltage, the control circuit includes a comparison circuit which compares the detection voltage with a predetermined reference voltage, and the control circuit controls a switching element to switch through which of the light-emitting element or light-emitting elements from among the plurality of light-emitting elements the current flows when the detection voltage decreases less than the predetermined reference voltage.

7. The lighting device according to claim 1, wherein the control circuit includes a sequential circuit which employs a flip flop.

8. The lighting device according to claim 1, further comprising:

a capacitor for smoothing the current to be supplied to the light-emitting element, the capacitor being connected to an output terminal of the DC-power supply circuit, wherein the control circuit operates using residual charge at the capacitor, when the power switch is turned off.

9. The lighting device according to claim 1, further comprising:

a capacitor for smoothing the current to be supplied to the light-emitting element, the capacitor being connected to an output terminal of the DC-power supply circuit, wherein the control circuit operates using residual charge at the capacitor, when the power switch is turned off, the lighting device further comprising:

a reset circuit which resets the control circuit when a second voltage decreases less than a reference voltage, wherein the second voltage is greater than the reference voltage when the power switch is on, and decreases as a first voltage of the capacitor decreases when the power switch is turned off.

10. The lighting device according to claim 9, wherein when the control circuit is reset, the control circuit controls the switching circuit so that one or more predetermined light-emitting elements are selected from among the plurality of light-emitting elements as light-emitting elements to be supplied with the current.

11. The lighting device according to claim 9, wherein the reset circuit includes a constant voltage generating element which generates the reference voltage using the first voltage.

12. The lighting device according to claim 9, wherein the reset circuit includes a divider resistor which divides the first voltage by resistance to generate the second voltage.

13. The lighting device according to claim 9, further comprising:

a controlled power supply circuit which generates a power supply voltage for the control circuit, using output voltage of the DC-power supply circuit, wherein the second voltage is the power supply voltage.

14. The lighting device according to claim 9, wherein the reset circuit includes a bipolar transistor having a base to which the second voltage is applied and an emitter to which the reference voltage is applied, and the control circuit is reset based on voltage at a collector of the bipolar transistor.

15. The lighting device according to claim 9, wherein the reset circuit includes a comparator which compares the second voltage with the reference voltage, and the control circuit is reset based on an output signal of the comparator.

16. The lighting device according to claim 9, wherein the control circuit includes a sequential circuit which employs a flip flop, and the reset circuit resets the flip flop.

17. A lighting fixture comprising:

the lighting device according to claim 1; and the plurality of light-emitting elements which are supplied with the current from the lighting device.

18. The lighting device according to claim 1, wherein the DC-power supply circuit includes a DC-to-DC converter that includes a first switching element for regulating the current supplied to the plurality of light-emitting current, and the switching circuit is connected to the DC-power supply through the plurality of light-emitting elements, and includes second switching elements for switching through which of the light-emitting element or light-emitting elements from among the plurality of light-emitting elements the current from the DC-power supply circuit flows.

19. The lighting device according to claim 1, wherein the plurality of light-emitting elements includes a plurality of light-emitting groups that are connected in parallel with each other, and the detection circuit includes a resistor that is connected in series to the plurality of light-emitting groups, and detects the current supplied to the plurality of light-emitting elements.

20. The lighting device according to claim 1, wherein the plurality of light-emitting elements includes a first light-emitting group and a second light-emitting group, the switching circuit includes a first switching element that is connected in series to the first light-emitting group and a second switching element that is connected in series to the second light-emitting group, and the control circuit:

detects a first event, a second event following the first event, and a third event following the second event, each of which occurs as a result of the current supplied to the plurality of light emitting elements changing from the on value to the off value and back to the on value caused by the power switch being turned from on to off and back to on within a predefined period;

maintains the first switching element to be turned on and the second switching element to be turned off during a time period from the first event to the second event; and maintains the first switching element to be turned off and the second switching element to be turned on during a time period from the second event to the third event.

* * * * *